US008206885B2

(12) United States Patent
Ogawa et al.

(10) Patent No.: US 8,206,885 B2
(45) Date of Patent: Jun. 26, 2012

(54) TONER FOR FORMING IMAGES, ONE-COMPONENT DEVELOPER, TWO-COMPONENT DEVELOPER, IMAGE FORMING METHOD, IMAGE FORMING APPARATUS AND PROCESS CARTRIDGE

(75) Inventors: Satoshi Ogawa, Nara (JP); Tatsuya Morita, Fujisawa (JP)

(73) Assignee: Ricoh Company Limited, Tokyo (JP)

( * ) Notice: Subject to any disclaimer, the term of this patent is extended or adjusted under 35 U.S.C. 154(b) by 223 days.

(21) Appl. No.: 12/697,692

(22) Filed: Feb. 1, 2010

(65) Prior Publication Data

US 2010/0227266 A1 Sep. 9, 2010

(30) Foreign Application Priority Data

Mar. 5, 2009 (JP) ..... 2009-052251

(51) Int. Cl.
*G03G 5/00* (2006.01)

(52) U.S. Cl. ..... 430/137.18; 430/108.1; 430/109.4

(58) Field of Classification Search ..... 430/108.1, 430/109.4, 137.18
See application file for complete search history.

(56) References Cited

U.S. PATENT DOCUMENTS

| | | | | |
|---|---|---|---|---|
| 5,414,052 | A * | 5/1995 | Mahabadi et al. | 525/437 |
| 5,773,185 | A * | 6/1998 | Yachi et al. | 430/137.17 |
| 2007/0275315 | A1 | 11/2007 | Nagatomo et al. | |
| 2008/0226356 | A1 | 9/2008 | Yasunaga et al. | |
| 2008/0227009 | A1 | 9/2008 | Fuwa et al. | |
| 2008/0233506 | A1 | 9/2008 | Hagi et al. | |
| 2009/0041511 | A1 | 2/2009 | Fuwa et al. | |
| 2009/0068579 | A1 | 3/2009 | Ogawa et al. | |
| 2009/0155710 | A1 | 6/2009 | Aoki et al. | |
| 2009/0233218 | A1 | 9/2009 | Ogawa | |

FOREIGN PATENT DOCUMENTS

| | | |
|---|---|---|
| JP | 3044595 | 3/2000 |
| JP | 3478963 | 10/2003 |
| JP | 2007-72333 | 3/2007 |
| JP | 2007-206097 | 8/2007 |

* cited by examiner

*Primary Examiner* — Mark A Chapman
(74) *Attorney, Agent, or Firm* — Oblon, Spivak, McClelland, Maier & Neustadt, L.L.P.

(57) ABSTRACT

A toner prepared by pulverization methods, including a binder resin; and a colorant, wherein the binder resin is prepared by melting and kneading a polyester resin having an unsaturated bond with a crosslinking reaction initiator diluted with a release agent, and the colorant is a press cake pigment after washed.

16 Claims, 2 Drawing Sheets

TONER FOR FORMING IMAGES, ONE-COMPONENT DEVELOPER, TWO-COMPONENT DEVELOPER, IMAGE FORMING METHOD, IMAGE FORMING APPARATUS AND PROCESS CARTRIDGE

BACKGROUND OF THE INVENTION

1. Field of the Invention

The present invention relates to a toner for electrophotography, and more particularly to a toner for forming images for use in image forming apparatuses using electrophotographic methods such as electrostatic copiers and laser beam printers, an to a one-component developer, a two-component developer, an image forming method, an image forming apparatus and a process cartridge using the toner.

2. Discussion of the Background

Since image forming apparatus are now being required to produce more images per unit time, they are demanded to produce images at higher speed. Because of this, they are required to technically have more severe conditions. Particularly for electrophotographic methods being used for on-demand digital printings, wider temperature ranges are needed not to generate offset while producing images having high glossiness.

However, a heat energy per unit time (nip time) providable to a toner for forming images (hereinafter referred to as a "toner") is less than ever before because of the recent high-speed printing and environment-friendliness. Therefore, a toner is occasionally not fully heated and melted on the surface of a recording medium.

When a toner is not fully melted when fixed, a toner layer on a recording medium is cut into two parts at a point which is not fully melted due to insufficient viscosity. One of the part remains on the recording medium and the other part adheres to a fixing roller. Alternatively, since the toner does not fully adhere to the recording medium, all the toner thereon occasionally adhere to the fixing roller (offset). The toner adhering to the fixing roller is fixed on an undesired place on recoding medium fed next, resulting in ghost images. Namely, when a toner is not fully heated, so-called a cold offset problem occurs.

Even when the cold offset problem does not occur, low-quality images such as images having noticeably deteriorated glossiness are produced.

Therefore, toners including a resin and a release agent having a low softening (melting) point, and a fixation aid are strenuously developed for the purpose of fixing the toner at lower temperature.

For examples, the applicant of the present invention discloses in Japanese published unexamined application No. 2007-72333 specifying a difference between endothermic peaks of a toner before and after heated at 40° C. for 72 hrs, and in Japanese published unexamined application No. 2007-20697 specifying a ratio of an FTIR spectrum of a crystalline polyester resin included in a toner before stored to that thereof after stored 45° C. for 12 hrs to improve low-temperature fixability, heat-resistant storage ability and offset resistance of a toner.

In addition, the applicant discloses in Japanese Patent No. 3478963 specifying dispersion diameters of a colorant and a release agent in a binder resin, respectively and a charge quantity of a toner (charge-up ratio Z (%)=$Q_{20}/Q_{600}\times100$ wherein $Q_{600}$ is a charge quantity when a toner having a concentration of 5% is mixed with a carrier for 10 min at normal temperature and normal humidity, and $Q_{20}$ is a charge quantity when the toner is mixed therewith for 20 sec) to improve image density, color reproducibility, offset resistance and charge-up property of the toner.

However, a toner having good low-temperature fixability is typically solidified under an environment of high temperature. Namely, the low-temperature fixability and the heat resistant storage ability of a toner have a trade-off relationship. In other words, toners are required to fix at lower heat energy because image forming apparatuses are required to produce images at higher speed, but toners having good low-temperature fixability do not have sufficient heat resistant storage ability and is difficult to store and transport under an environment of high temperature. Toners having good heat resistant storage ability do not have sufficient low-temperature fixability, resulting in image quality problems such as cold offset.

As disclosed in Japanese Patent No. 3044595, for toners prepared by pulverization methods including a melting process and a kneading process, methods of widening fixable and releasable temperature thereof, in which two or more resins having a different molecular weight or a rheology from each other are heated and kneaded such that a low-molecular-weight resin has toners have low-temperature fixability on base media (recording media) and a polymeric or highly-elastic/highly-viscous resin prevents toners from adhering to fixing rollers and offsetting when fixed at high temperature, are widely used.

However, when two or more resins having noticeably a different molecular weight or a rheology from each other are heated and kneaded to widen fixable temperature of a toner, a shearing strength is not applied to the resins when kneaded due to a difference of the viscosities of the resins, resulting in uneven dispersion thereof. In this case, highly-viscous and low-viscous parts are observed as a sea and island structure, and dispersibilities of a pigment, a release agent or a charge controlling agent noticeably deteriorate, resulting in low fixability of a toner, production of images having uneven image density, foggy images and particularly images having low color saturation.

Particularly, in high-speed printing machines applying less heat energy per unit time, images having low color saturation are noticeably produced, and which is a problem to be immediately solved when using toners prepared by pulverization methods.

Because of these reasons, a need exists for a toner having good storage ability and good fixability, and producing images having good color reproducibility and high image density.

SUMMARY OF THE INVENTION

Accordingly, an object of the present invention is to provide a toner prepared by pulverization methods, having hot offset resistance, good low-temperature fixability and a wide offset band, a pigment in which is uniformly dispersed, and producing images having high glossiness and high color saturation.

Another object of the present invention is to provide a one-component or a two-component developer using the toner.

A further object of the present invention is to provide an image forming method using the toner.

Another object of the present invention is to provide an image forming apparatus using the toner.

A further object of the present invention is to provide a process cartridge using the toner.

These objects and other objects of the present invention, either individually or collectively, have been satisfied by the discovery of a toner prepared by pulverization methods, comprising:

a binder resin; and a colorant, wherein the binder resin is prepared by melting and kneading a polyester resin having an unsaturated bond with a crosslinking reaction initiator diluted with a release agent, and the colorant is a press cake pigment after washed.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
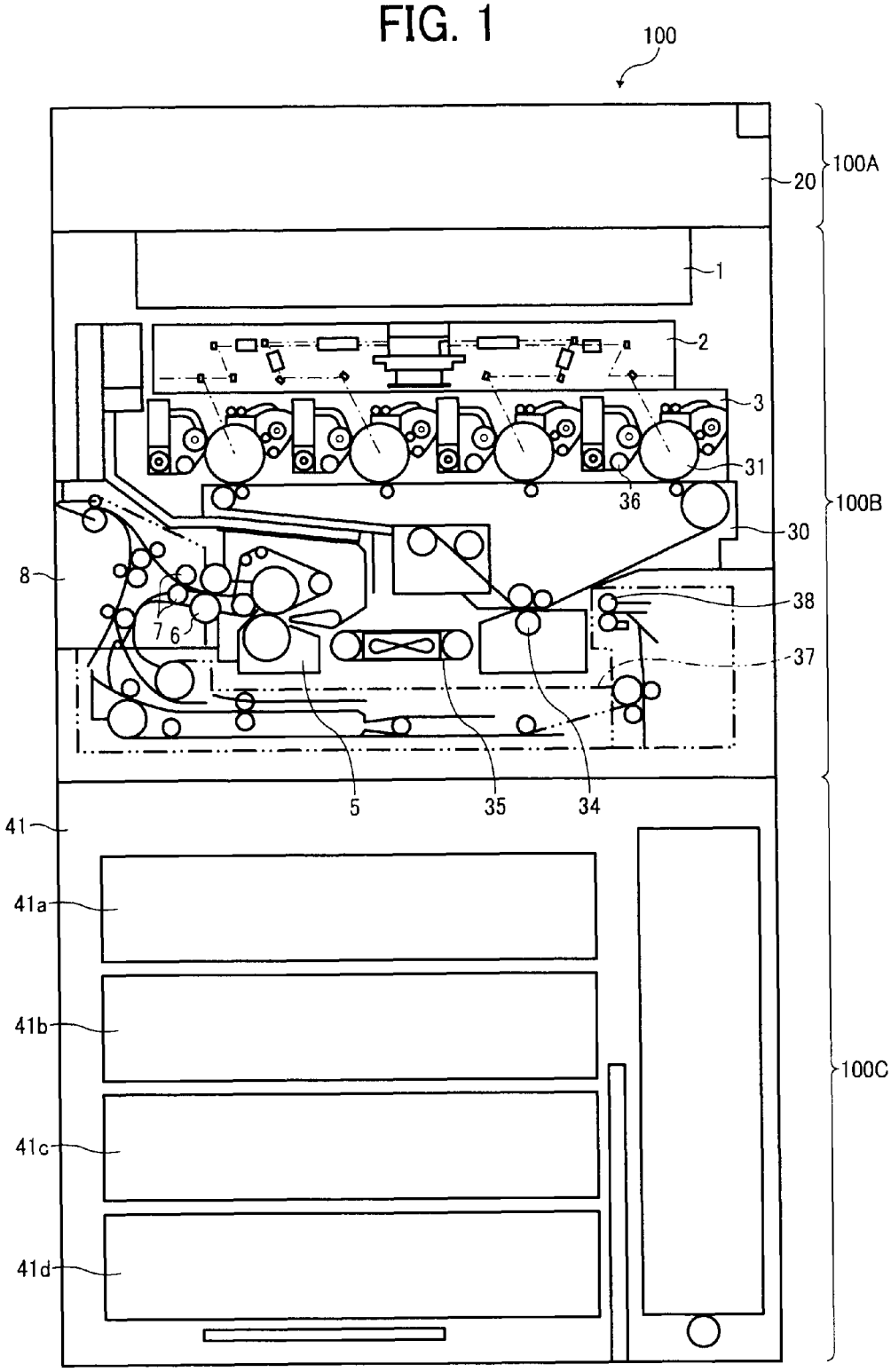
FIG. 1 is a schematic view illustrating an embodiment of the image forming apparatus of the present invention.

The present invention provides a toner having good storage ability and good fixability, and producing images having good color reproducibility and high image density. More specifically, a toner prepared by pulverization methods, having hot offset resistance, good low-temperature fixability and a wide offset band, a pigment in which is uniformly dispersed, and producing images having high glossiness and high color saturation is provided. More particularly, the present invention relates to a toner prepared by pulverization methods, comprising:

a binder resin; and a colorant, wherein the binder resin is prepared by melting and kneading a polyester resin having an unsaturated bond with a crosslinking reaction initiator diluted with a release agent, and the colorant is a press cake pigment after washed.

Namely, the toner of the present invention includes a binder resin which is a polyester resin having an unsaturated bond. Processes of preparing the polyester includes a process of diluting a crosslinking reaction initiator with a release agent. A press cake pigment after washed is used as the colorant.

The polyester resin is preferably used in the present invention as a binder resin for full-color toners in terms of controlling thermal properties. The crosslinking reaction initiator is diluted to control the polyester resin to have a low crosslink density. Elasticity is imparted to the resin while low viscosity thereof is kept to prepare a toner having high glossiness, color reproducibility and wide fixability. The release agent is used as a diluent to exert a release effect and less harmful effects on toner properties even when remaining therein. The press cake pigment having good dispersibility is used to produce images having higher color reproducibility.

The polyester resin can be synthesized from the following polyols and polycarboxylic acids.

Specific examples of the polyols include diols such as ethylene glycol, propylene glycol, 1,3-butanediol, 1,4-butanediol, 2,3-butanediol, diethyleneglycol, triethylene glycol, 1,5-pentanediol, 1,6-hexanediol, neo-pentyl glycol, 1,4-cyclohexanedimethanol, dipropyleneglycol, polyethyleneglycol, polypropyleneglycol, bisphenol A, hydrogenated bisphenol A, adducts of bisphenol A with alkyleneoxide, e.g., polyoxyethylated bisphenol A and polyoxypropylated bisphenol A.

Tri- or more polyols are preferably used to make polymers nonlinear such that tetrahydrofuran-insoluble components do not generate. Specific examples of the tri- or more polyols include glycerin, sorbitol, 1,2,3,6-hexanetetraol, 1,4-sorbitan, pentaerythritol, 1,2,4-butanetriol, 1,2,5-pentanetriol, 2-methylpropanetriol, 2-methyl-1,2,4-butanetriol, trimethylolethane, trimethylolpropane, 1,3,5-trihydroxybenzene, etc.

Specific examples of the polycarboxylic acids include dicarboxylic acids such as a maleic acid, a fumaric acid, a citraconic acids, an itaconic acid, a glutaconic acid, a phthalic acid, a terephthalic acid, an isophthalic acid, a cyclohexane dicarboxylic acid, a malonic acid, a succinic acid, an adipic acid, a sebacic acid, a glutaric acid, alkyl succinic acids (e.g., a n-octylsuccinic acid and a n-dodecenylsuccinic acid, their anhydrides or lower alkyl esters, etc.

Specific examples of tri- or more carboxylic acids include a 1,2,4-benzenetricarboxylic acid, a 2,5,7-naphthalenetricarboxylic acid, a 1,2,4-naphthalenetricarboxylic acid, a 1,2,4-butanetricarboxylic acid, a 1,2,5-hexanetricarboxylic acid, 1,3-dicarboxyl-2-methyl-methylenecarboxypropane, tetra (methylenecarboxyl)methane, a 1,2,7,8-octantetracarboxylic acid, an empol trimer acid, and their anhydrides and lower alkyl esters, etc.

The binder resin for use in the present invention preferably has an acid value, but not limited to, of from 10 to 30 mg KOH/g in consideration of dispersibility and environmental properties of a colorant.

The binder resin for use in the present invention is preferably a polyester resin having a number-average molecular weight of from 4,000 to 12,000, and more preferably from 4,000 to 8,000. In addition, the polyester resin preferably has a ratio of a weight-average molecular weight (Mw) to a number-average molecular weight (Mn) [Mw/Mn] of from 2 to 8, and more preferably from 3 to 6. Such polyester resins can prepare a toner having good fixability and producing images having high image density and color reproducibility.

When the number-average molecular weight is less than 4,000 or the ratio of a weight-average molecular weight (Mw) to a number-average molecular weight (Mn) [Mw/Mn] is less than 2, the resultant images have poor fixability, the surface of a toner layer offsets and becomes rough, resulting in poor color reproducibility. When the number-average molecular weight is greater than 12,000 or the ratio of a weight-average molecular weight (Mw) to a number-average molecular weight (Mn) [Mw/Mn] is greater than 8, the resultant image glossiness deteriorates, the toner boundary is present even when fixed and light scatters, resulting in deterioration of color reproducibility and image density.

The average molecular weight of the binder resin is measured by a GPC measurer GPC-150C from Waters Corp. A column (KF801 to 807 from Shodex) is stabilized in a heat chamber having a temperature of 40° C.; THF is put into the column at a speed of 1 ml/min as a solvent; a sample having a concentration of from 0.05 to 0.6% by weight, is put into the column to measure a molecular weight distribution of the binder resin. From the molecular weight distribution thereof, the weight-average molecular weight and the number-average molecular weight of the binder resin are determined by using a calibration curve which is previously prepared using several polystyrene standard samples having a single distribution peak.

A crosslinking reaction initiator diluted with a release agent is used to crosslink the binder (polyester) resin having an unsaturated bond.

The release agents for use in the present invention include natural waxes, e.g., animal waxes such as a bees wax, a whale wax and a shellac wax; plant waxes such as a carnauba wax, a Japan wax, a rice wax and a candelilla wax; petroleum waxes such as a paraffin wax and a microcrystalline wax; mineral waxes such as a montan wax and an ozokerite; and synthesized waxes such a Fischer-Tropsch wax, a polyethylene wax, a fatty synthesized waxes (ester, ketone and amide) and a hydrogenated wax. The release agent preferably has an endothermic peak of from 80 to 110° C. when measured by a differential scanning calorimeter to execute an exuding effect at low temperature.

A direct-chain hydrocarbon is preferably used in terms of fixability and releasability as a release agent. Even a small amount of the direct-chain hydrocarbon having high releasability when remaining in a toner can prepare a toner having good fixability and producing images having high image density and color reproducibility.

Specific examples of the direct-chain hydrocarbon include a paraffin wax, a microcrystalline wax and a polyethylene wax. The release agent in the present invention is used for diluting a crosslinking reaction initiator. However, the release agent may be combined with a binder resin, a colorant, etc. when melted and kneaded. In that case, a release agent different from the release agent for dilution can be used.

A toner preferably includes a release agent in an amount of from 1 to 6% by weight, and more preferably from 2 to 5% by weight to have better fixability. When less than 1% by weight, the releasability and fixability deteriorate. When greater than 6% by weight, the release agent increases light scattering, resulting in deterioration of color reproducibility.

Any known radical reactants can be used as the crosslinking reaction initiator. Specific examples of organic peroxides include benzoylperoxide, di-t-butylperoxide, t-butylcumylperoxide, dicumylperoxide, α,α-bis(t-butylperoxy)diisopropylbenzene, 2,5-dimethyl-2,5-bis(t-butylperoxy)hexane, di-t-hexylperoxide, 2,5-dimethyl-2,5-di-t-butilperoxyhexine-3, acetylperoxide, isobutyrylperoxide, octanoylperoxide, decanoylperoxide, lauroylperoxide, 3,3,5-trimethylhexanoylperoxide, m-tolylperoxide, t-butylperoxyisobutylate, t-butylperoxyneodecanoate, cumylperoxyneodecanoate, t-butylperoxy2-ethylhexanoate, t-butylperoxy-3,5,5-trimethylhexanoate, t-butylperoxylaurate, t-butylperoxybenzoate, t-butylperoxyisopropylcarbonate, t-butylperoxyacetate, etc.

The crosslinking reaction initiator can be diluted with a release agent by any known heat kneaders, e.g., continuous biaxial kneaders such as KTK from Kobe Steel, Ltd., TEM from Toshiba Machine Co., Ltd., PCM from Ikegai Co., Ltd. and KEX from Kurimoto Ltd.; monoaxial kneaders such as KOKNEADER from Buss Corporation and a kneader from KCK Co., Ltd.; and direct open roll continuous kneader KNEADEX from Mitsui Mining Co., Ltd.

The crosslinking reaction initiator can be diluted to have various concentrations in compliance with properties of the binder resin. The crosslinking reaction initiator preferably has a concentration of from 0.1 to 100 parts by weight, and more preferably from 1 to 30 parts by weight per 100 parts by weight of the binder resin. When less than 0.1 parts by weight, the crosslinking reaction does not go well to form a polymer. When greater than 100 parts by weight, the crosslinking reaction goes at higher speed, and has too uneven a crosslinking point to uniformly form a polymer.

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and their mixtures.

In the present invention, a press cake which is washed and undried is used. Particulate pigments are so small that they agglutinate with a very high cohesion force when powdered. Once they agglutinate, it is difficult to break them even with a large shearing force. The press cake pigments are difficult to agglutinate because of holding moisture among them. The pigments displaced with a binder resin when kneaded can disperse without agglutinating. The press cake pigment preferably includes a pigment in an amount of from 10 to 60% by weight, and more preferably from 30 to 50% by weight.

The toner preferably includes a colorant (solid content) in an amount of from 3 to 10% by weight, and more preferably from 3 to 7% by weight to produce images having high image density and to have high color reproducibility. When less than 3% by weight, images having high image density cannot be produced or solid images have lower colorfulness due to insufficient absorption of light. When greater than 10% by weight, images having lower color reproducibility due to insufficient pigment dispersion or images having lower colorfulness due to an excessive absorption of reflection-area light are produced.

The toner of the present invention may include a charge controlling agent without impairing the effect of the present invention when necessary. Specific examples of the charge controlling agent include known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, salicylic acid derivatives, etc.

Specific examples of the marketed products of the charge controlling agents include BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge controlling agent is determined such that the resultant toner has desired chargeability, however, the toner preferably includes the charge controlling agent in an amount of from 0.1 to 10% by weight, and more preferably from 0.2 to 5% by weight. When greater than 10% by weight, the toner has too high chargeability, and thereby the electrostatic force of a developing roller attracting the toner increases, resulting in deterioration of the fluidity of the toner and decrease of the image density of toner images. When less than 0.1% by weight, the toner has insufficient charge buildability or charge quantity, resulting in occasional poor quality toner images.

The toner of the present invention is prepared by dry mixing toner materials to prepare a mixture, melting and kneading the mixture by a kneader to prepare a kneaded mixture, cooling and solidifying the kneaded mixture to prepare a solid mixture, and pulverizing and classifying the solid mixture. The kneader is preferably an open roll kneader. A moisture included in the press cake pigment of the present invention can efficiently be removed thereby. The open-type kneader capable of applying a high shearing force can prepare a toner having high color reproducibility, in which a pigment is dispersed well.

In order to improve fluidity, preservability, developability and transferability of the toner, the thus prepared parent toner can be mixed with an inorganic particulate material (external additive). Suitable mixers for use in mixing the mother toner particles and an external additive include known mixers for mixing powders, which preferably have a jacket to control the inside temperature thereof. By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used. Specific examples of the mixers include V-form mixers, locking mixers, Loedge Mixers, NAUTER MIXERS, HENSCHEL MIXERS and the like mixers. Then, coarse particles and aggregation particles are removed from a coarse toner through a sieve having 250 meshes or more to prepare a toner. Other components such as a particulate resin and a release agent may optionally be added to the toner.

Specific examples of the inorganic particulate materials include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

The inorganic particulate material (external additive) is preferably surface-treated to improve hydrophobicity thereof and prevents deterioration of fluidity and chargeability thereof even under an environment of high humidity. Specific examples of the surface treatment agent include silane coupling agents, sililating agents, silane coupling agents having an alkyl fluoride group, organic titanate coupling agents, aluminium coupling agents silicone oils and modified silicone oils.

The inorganic particulate material (external additive) preferably has a primary particle diameter of from $5\times10^{-3}$ to 2 μm, and more preferably from $5\times10^{-3}$ to 0.5 μm. The inorganic particulate material preferably has a specific surface area of from 20 to 500 $m^2/g$. The toner preferably includes the inorganic particulate material in an amount 0.01 to 5% by weight, and more preferably from 1 to 3% by weight.

The toner of the present invention can have a desired weight-average particle diameter without a particular limit, however, preferably from 3.5 to 10 μm to produce high-definition images having good granularity, sharpness and thin-line reproducibility. The smaller the particle diameter, the better the sharpness and the thin-line reproducibility. Particularly, full-color image forming apparatuses need a toner having a particle diameter not greater than 10 μm, more preferably not greater than 7.5 μm. When less than 3.5 μm, the resultant toner deteriorates in its fluidity and transferability.

The weight-average particle diameter was measured by particle diameter measurers, e.g., Coulter Counter TA-II or Coulter Multisizer III from Beckman Coulter, Inc. as follows:

0.1 to 5 ml of a detergent, preferably alkylbenzene sulfonate is included as a dispersant in 100 to 150 ml of the electrolyte ISOTON-II from Coulter Scientific Japan, Ltd., which is a NaCl aqueous solution including an elemental sodium content of 1%;

2 to 20 mg of a toner sample is included in the electrolyte to be suspended therein, and the suspended toner is dispersed by an ultrasonic disperser for about 1 to 3 min to prepare a sample dispersion liquid; and a volume and a number of the toner particles for each of the following channels are measured by the above-mentioned measurer using an aperture of 100 μm to determine a weight distribution and a number distribution:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

The weight-average particle diameter (Dw) and the number-average particle diameter of the toner can be determined from the distributions.

The toner of the present invention preferably has a glass transition temperature (Tg) of from 60 to 65° C. When higher than 65° C., the resultant toner has a higher minimum fixable temperature and deteriorates in low temperature fixability.

The glass transition temperature (Tg) can be determined from a contact point between a tangent of a heat absorption curve close to Tg and base line using TG-DSC system TAS-100 from RIGAKU Corp.

Namely, about 10 mg of a sample in an aluminum container was placed on a holder unit, and which was set in an electric oven. The sample was heated in the oven at from a room temperature to 180° C. and a programming speed of 10° C./min to obtain the heat absorption curve.

The toner of the present invention is prepared by melting and kneading a polyester resin having an unsaturated bond with a crosslinking reaction initiator diluted with a release agent (diluent) to prepare a binder resin; melting and kneading the binder resin with a colorant, a charge controlling agent, etc. to prepare a kneaded mixture; cooling and solidifying the kneaded mixture to prepare a solidified mixture; pulverizing the solidified mixture to prepare a powder; and classifying the powder. An embodiment of procedures for preparing the toner is explained, but the procedures are not limited thereto.

Namely, a method of preparing the toner of the present invention includes fully mixing the polyester resin having an unsaturated bond, a pigment or a dye as a colorant, a crosslinking reaction initiator diluted with a release agent (diluent), and further optional charge controlling agent and other additives in a mixer such as HENSCHEL MIXER to prepare a mixture; kneading the mixture preferably with an open roll continuous kneader KNEADEX from Mitsui Mining Co., Ltd. to prepare a kneaded mixture; cooling the kneaded mixture to prepare a solidified mixture; crushing the solidified mixture to prepare a crushed mixture; pulverizing the crushed mixture with a pulverizer using jet stream or a mechanical pulverizer to prepare a powder; and classifying the powder with a classifier using swirling airflow or Coanda effect to have a predetermined particle diameter.

Further, inorganic particulate material as an external additive and the classified toner may be fully mixed in a mixer such as HENSCHEL MIXER to prepare a mixture, and then coarse particles and aggregation particles may be removed therefrom through a sieve having 250 meshes or more to prepare the toner.

The toner of the present invention can be used as a one-component developer or in a two-component developer.

The one-component developer includes a one-component non-magnetic toner which is the toner itself and a one-component magnetic toner which includes a magnetic material.

The magnetic material includes a strong magnetic materials having ferromagnetism or ferrimagnetism. Specific examples of the ferromagnetic material include Fe, Ni, Co and their alloys; and oxides such as $CrO_2$. Specific examples of the ferrimagnetic material include spinel ferrites such as $MnFe_2O_4$, $Fe_3O_4$, $\gamma$-$Fe_2O_3$, $NiZnFe_4O_6$ and $ZnFe_2O_4$; and garnets such as $Y_3Fe_6O_{12}$. The toner preferably includes the magnetic material in an amount of from 5 to 80% by weight, and more preferably from 20 to 60% by weight.

Conventionally-known carriers can be used in the two-component developer including the one-component non-magnetic toner of the present invention and a carrier.

For example, a carrier formed of a magnetic particulate material such as iron and ferrite, a resin-coated carrier which is the magnetic particulate material coated with a resin or a binder carrier formed of a fine powder of a magnetic material dispersed in a binder resin, etc. can be used.

Specific examples of the magnetic materials include magnetic iron oxides such as magnetite, hematite and ferrite and iron oxides including other metal oxides; metals such as iron, cobalt and nickel or their metal alloys with metals such as aluminum, cobalt, copper, lead, magnesium, tin, zinc, antimony, beryllium, bismuth, cadmium, calcium, manganese, selenium, titanium, tungsten and vanadium; and their mixtures.

Particularly, the resin-coated magnetic particulate materials coated with silicone resins, graft copolymer resins of organopolysiloxane and vinyl monomers or polyester resins are preferably used. Further, the resin-coated magnetic particulate materials coated with resins wherein isocyanate is reacted with the graft copolymer resins of organopolysiloxane and vinyl monomers are more preferably used in terms of durability and environment resistance.

The vinyl monomers need to have substituents such as hydroxyl groups reactive with isocyanate. The magnetic carrier preferably has a volume-average particle diameter of from 20 to 100 μm, and more preferably from 20 to 60 μm.

Specific examples of the materials coating a carrier other than the above include amino resins such as urea-formaldehyde resins, melamine resins, benzoguanamine resins, urea resins, polyamide resins and epoxy resins; polyvinyl and polyvinylidene resins such as acrylic resins, polymethylmethacrylate resins, polyacrylonitirile resins, polyvinyl acetate resins, polyvinyl alcohol resins and polyvinyl butyral resins; polystyrene resins such as polystyrene resins and styrene-acrylic copolymers; halogenated olefin resins such as polyvinyl chloride resins; polyester resins such as polyethyleneterephthalate resins and polybutyleneterephthalate resins; fluoroterpolymers such as polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom; and silicone resins.

An electroconductive powder may optionally be included in the toner as a filler. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, it is hard to control the resistance of the resultant toner.

The image forming method of the present invention includes at least a charging process charging the surface of an image bearer; an electrostatic latent image forming process forming an electrostatic latent image on the image bearer; developing process developing the electrostatic latent image with an image forming toner to form a visual image; transfer process transferring the visual image onto a recording medium to form an unfixed image thereon; and a fixing process fixing the unfixed image on the recording medium. The image forming toner is the toner of the present invention. The toner can be fixed on the recording medium even when fed at 280 mm/sec or faster.

The image forming method of the present invention can stably produce high-quality images having good glossiness without ghost even when producing images with a high-speed electrophotographic image forming apparatus because of using an image forming toner having good low-temperature fixability and heat-resistant storage stability, fixable only on a desired position of a recording medium without offset phenomenon.

The image forming apparatus of the present invention includes at least an image bearer; a charger charging the surface of the image bearer; an irradiator irradiating the charged surface of the image bearer to form an electrostatic latent image; image developer developing the electrostatic latent image with an image forming toner to form a visual image; transferer transferring the visual image onto a recording medium to form an unfixed image thereon; and a fixer fixing the unfixed image on the recording medium. The image forming toner is the toner of the present invention.

The image forming apparatus of the present invention can stably fix images without producing abnormal images even at high process linear speed because of using an image forming toner having good low-temperature fixability and heat-resistant storage stability, fixable only on a desired position of a recording medium without offset phenomenon. A tandem-type full-color image forming apparatus using the toner of the present invention can produce high-quality images at higher speed.

The image forming method and apparatus of the present invention can widely be used for electrophotographic applications using electrophotographic methods such as electrostatic copiers and laser beam printers.

As an embodiment of the image forming apparatus of the present invention, a tandem-type full-color image forming will be explained, referring to the drawing.

FIG. 1 is a schematic view illustrating an embodiment of the image forming apparatus of the present invention, which is a digital color copier.

A color copier 100 includes an image reader 100A located above the apparatus, an image former 100B located at the center of thereof and a paper feeder 100C located below the apparatus. The images reader 100A includes a scanner 1 optically reading image information on a document and an ADF (automatic document feeder) 20 continuously feeding documents to the scanner 1. A belt-shaped intermediate transferer 30 having a transfer surface extending in a horizontal direction is located in the image former 100B. A configuration for forming images having a color complementary to a color separation color on the upper surface of the intermediate transferer 30. Namely, four photoreceptors 31 capable of bearing toner images having complementary colors (yellow, magenta, cyan and black) as image bearers are located along the intermediate transferer 30 in line.

An irradiator 2 irradiating a circumferential surface of each photoreceptor 31 with light based on the scanner image information or an outer image information is located above the photoreceptor 31. The photoreceptors 31 are formed of drums rotatable in the same direction (anticlockwise direction), and a developing unit 3 including a charger, an image developer and a first transferer to form images in the process of rotating; and a cleaning unit 36 collecting a toner remaining on the photoreceptor 31 after transfer are located around each of the photoreceptors 31. Each of the image developers includes each color toner.

The intermediate transferer 30 is hung around a drive roller and a driven roller and transportable at a position facing each photoreceptor 31 in the same direction thereof. A second transferer 34 which is a transfer roller is located at a position facing one of the driven rollers. On a pass line from the second transferer 34, a feed belt 35, a fixer 5, a gloss applicator 6 and a pair of feed rollers 7 are located in this order.

The paper feeder 100C includes paper feed trays 41 loading and containing papers as recording media (41*a*, 41*b*, 41*c* and 41*d*), a feed path 37 separating an uppermost paper from the papers in each of the feed trays 41 and feeding the paper to the second transferer and a feed mechanism including a register 38 adjusting image formation and timing or skew.

In the image forming apparatus 100, the surface of the photoreceptor 31 is uniformly charged by the charger of the developing unit 3, and the irradiator 2 forms an electrostatic latent image on each photoreceptor 31 relevant to the color based on scanner image information from the image reader 100A or external image information. The electrostatic latent image is visualized as a toner image by the image developer including a color toner relevant thereto, and the toner image is first transferred onto the intermediate transferer 30. Thus, each color toner image is electrostatically transferred onto the intermediate transferer 30 in sequence to be overlapped thereon.

Next, the toner image first transferred onto the intermediate transferer 30 is transferred onto a paper fed at the second transferer 34. The paper the toner image is transferred on is further fed to the fixer 5, where the toner image is fixed on the paper at a fixing nip between a fixing member such as a fixing belt and a pressure member such as a pressure roller. Next, the gloss applicator applies a gloss to the toner image fixed on the paper when necessary, the paper the toner image is fixed on is fed by the pair of feed rollers 7. The paper the toner image is fixed on is discharged from the apparatus after fed by a paper discharger 8 along a discharge path. Thus, a sequence of image forming process is completed.

The above-mentioned image forming units may be fixedly set in a copier, a facsimile or a printer. However, the image forming unit may be detachably set therein as a process cartridge.

Figure 2:
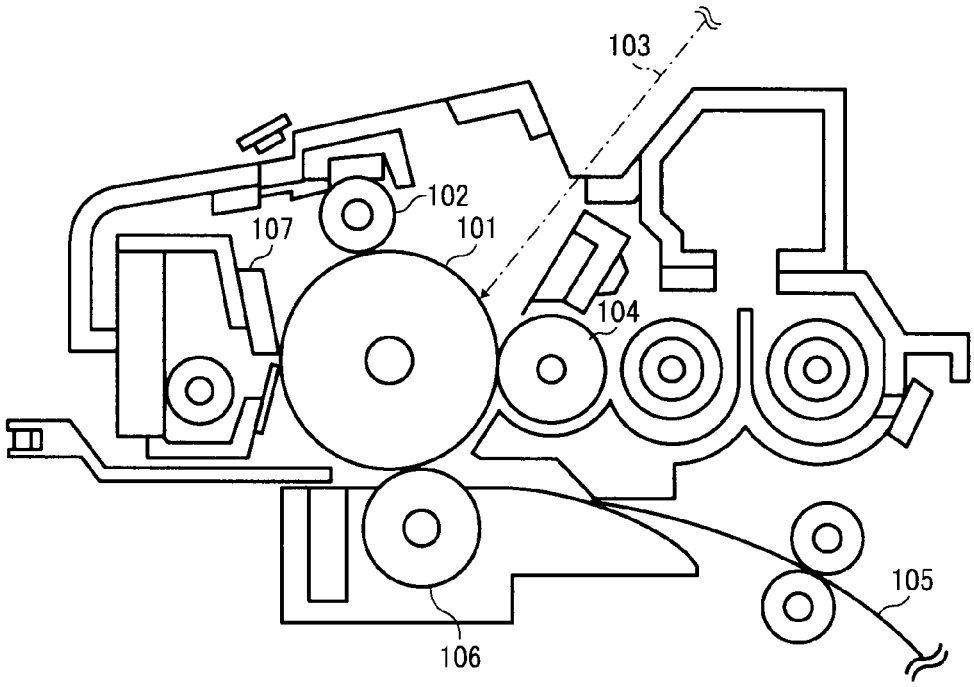
FIG. 2 is a schematic view illustrating an embodiment of the process cartridge of the present invention.

The process cartridge is an image forming unit (or device), including an image bearer (photoreceptor), and at least one of a charger, an irradiator, an image developer, a transferer, and a cleaner. The process cartridge may optionally include other means such as a discharger. FIG. 2 is a schematic view illustrating an embodiment of the process cartridge of the present invention. The process cartridge includes a photoreceptor 101, an image developer 104, a charger 102, a, a cleaner 107 and other means when necessary. In FIG. 1, numeral 106 is a transferer and 105 is a recording medium (transfer medium).

Namely, the process cartridge of the present invention is a process cartridge detachable from image forming apparatus, including an image bearer, and at least one of a charger charging the surface of the image bearer, an irradiator irradiating the surface of the charged image bearer to form an electrostatic latent image thereon, an image developer developing the electrostatic latent image with an image forming toner to form a toner image, a transferer transferring the toner image onto a recording medium and a cleaner removing a toner remaining on the surface of the image bearer after the toner image is transferred in a body. The image forming toner is the image forming toner of the present invention. The process cartridge may optionally include other means such as a discharger.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Polyester resins 1 to 6 were synthesized by the following methods. The weight-average molecular weight (Mw) and number-average molecular weight (Mn) of the polyester resin were measured by GPC from Waters Corp.

(Preparation of Polyester Resin 1)

443 parts of an adduct of bisphenol A with propyleneoxide (having a hydroxyl value of 320), 1,135 parts of diethyleneglycol, 211 parts terephthalic acid, 211 parts of fumaric acid and 2.5 parts of dibutyltinoxide were reacted in a reactor vessel including a cooling pipe, a stirrer and a nitrogen inlet pipe at 170° C. to prepare a reactant. A crosslinking reaction initiator benzoylperoxide from Merck diluted with a release agent HNP-9PD paraffin wax from NIPPON SEIROCO., LTD., having a melting point of 76.1° C. to have a concentration of 15% by weight was added to the reactant such that the resultant toner included the release agent in an amount of 4% by weight, and the reactant was further kneaded by a continuous biaxial extruder at 70° C. to prepare a polyester resin 1. The polyester resin 1 had a number-average molecular weight (Mn) of 6,800 and a ratio (Mw/Mn) of a weight-average molecular weight (Mw) to the number-average molecular weight (Mn) of 3.7.

(Preparation of Polyester Resin 2)

The procedure for preparation of the polyester resin 1 was repeated except for changing the reaction temperature from 170 to 150° C. The polyester resin 2 had a number-average molecular weight (Mn) of 3,800 and a ratio (Mw/Mn) of 1.8.

(Preparation of Polyester Resin 3)

The procedure for preparation of the polyester resin 1 was repeated except for changing the reaction temperature from 170 to 200° C. The polyester resin 3 had a number-average molecular weight (Mn) of 13,300 and a ratio (Mw/Mn) of 8.1.

(Preparation of Polyester Resin 4)

The procedure for preparation of the polyester resin 1 was repeated except for changing the concentration of the crosslinking reaction initiator from 15 to 5% by weight. The polyester resin 4 had a number-average molecular weight (Mn) of 6,800 and a ratio (Mw/Mn) of 1.8.

(Preparation of Polyester Resin 5)

The procedure for preparation of the polyester resin 1 was repeated except for replacing the release agent HNP-9PD with a carnauba wax having a melting point of 85° C. The polyester resin 5 had a number-average molecular weight (Mn) of 7,200 and a ratio (Mw/Mn) of 5.1.

(Preparation of Polyester Resin 6)

The procedure for preparation of the polyester resin 1 was repeated except that the resultant toner included the release agent in an amount of 0.5% by weight. The polyester resin 6 had a number-average molecular weight (Mn) of 6,800 and a ratio (Mw/Mn) of 3.7.

(Preparation of Polyester Resin 7)

The procedure for preparation of the polyester resin 1 was repeated except that the resultant toner included the release agent in an amount of 7% by weight. The polyester resin 7 had a number-average molecular weight (Mn) of 6,800 and a ratio (Mw/Mn) of 3.7.

(Preparation of Polyester Resin 8)

The procedure for preparation of the polyester resin 1 was repeated except that the resultant toner included the release agent in an amount of 1% by weight. The polyester resin 8 had a number-average molecular weight (Mn) of 6,800 and a ratio (Mw/Mn) of 3.7.

(Preparation of Polyester Resin 9)

The procedure for preparation of the polyester resin 1 was repeated except that the resultant toner included the release agent in an amount of 6% by weight. The polyester resin 9 had a number-average molecular weight (Mn) of 6,800 and a ratio (Mw/Mn) of 3.7.

(Preparation of Polyester Resin 10)

The procedure for preparation of the polyester resin 1 was repeated except for not using the release agent. The polyester resin 10 had a number-average molecular weight (Mn) of 10,900 and a ratio (Mw/Mn) of 7.6.

Example 1

The following materials were mixed in HENSCHEL MIXER 20B from Mitsui Mining Co., Ltd. for 5 min at 1,500 rpm to prepare a mixture.

| | |
|---|---|
| Polyester Resin 1 | 100 |
| Press cake pigment<br>C.I. Pigment red 122<br>Quinacridone magenta pigment<br>including a pigment in an amount<br>of 40% by weight (solid content) | 8 |
| Charge controlling agent<br>Zinc salicylate BONTRON E-84 from<br>Orient Chemical Industries, Co., Ltd. | 2 |

The mixture was kneaded by an open roll mixer MOS160 from Mitsui Mining Co., Ltd. at 100° C., pulverized and classified to prepare a powder-1 having a weight-average particle diameter of 6.8 μm.

Further, the powder-1 was kneaded, extended, cooled and pulverized by a pulverizer to prepare a pulverized material. The pulverized material was further pulverized by I-type mill IDS-2 from Nippon Pneumatic Mfg. Co., Ltd. using a flat impinging plate at an air pressure 6.8 atm/cm$^2$ and a feeding amount of 0.5 kg/hr to prepare a further pulverized material. The further pulverized material was classified with a classifier 132 MP from Alpine American Corp. to prepare a parent toner 1.

100 parts of the parent toner and 2.0 parts of a hydrophobic silica RX200 having an average particle diameter of 12 nm from Nippon Aerosil Co., Ltd. were mixed by a HENSCHEL MIXER 20B from Mitsui Mining Co., Ltd. at a peripheral speed of 30 m/sec for 30 sec and paused for 60 sec for 5 times to prepare a toner 1.

The toner 1 had a weight-average particle diameter (Dw) of 6.8 μm and a number-average particle diameter (Dn) of 5.3 μm. The weight-average particle diameter (Dw) and number-average particle diameter (Dn) were measured by the above-mentioned Coulter Multisizer III. The toner 1 had a weight-average molecular weight of 15,000.

Example 2

The procedure for preparation of the toner 1 was repeated except for replacing the polyester resin 1 with the polyester resin 2 to prepare a toner 2.

Example 3

The procedure for preparation of the toner 1 was repeated except for replacing the polyester resin 1 with the polyester resin 3 to prepare a toner 3.

Example 4

The procedure for preparation of the toner 1 was repeated except for replacing the polyester resin 1 with the polyester resin 4 to prepare a toner 4.

Example 5

The procedure for preparation of the toner 1 was repeated except for replacing the polyester resin 1 with the polyester resin 5 to prepare a toner 5.

Example 6

The procedure for preparation of the toner 1 was repeated except for replacing the polyester resin 1 with the polyester resin 6 to prepare a toner 6.

Example 7

The procedure for preparation of the toner 1 was repeated except for replacing the polyester resin 1 with the polyester resin 7 to prepare a toner 7.

Example 8

The procedure for preparation of the toner 1 was repeated except for changing 8 parts of the press cake pigment (solid content) into 2 parts thereof to prepare a toner 8.

Example 9

The procedure for preparation of the toner 1 was repeated except for changing 8 parts of the press cake pigment (solid content) into 12 parts thereof to prepare a toner 9.

Example 10

The procedure for preparation of the toner 1 was repeated except for changing 8 parts of the press cake pigment (solid content) into 3 parts thereof to prepare a toner 10.

Example 11

The procedure for preparation of the toner 1 was repeated except for changing 8 parts of the press cake pigment (solid content) into 10 parts thereof to prepare a toner 11.

Example 12

The procedure for preparation of the toner 1 was repeated except for replacing the polyester resin 1 with the polyester resin 8 to prepare a toner 12.

Example 13

The procedure for preparation of the toner 1 was repeated except for replacing the polyester resin 1 with the polyester resin 9 to prepare a toner 13.

Comparative Example 1

The procedure for preparation of the toner 1 was repeated except for replacing the polyester resin 1 with the polyester resin 10 and changing 8 parts of the press cake pigment (solid content) into 6 parts thereof to prepare a comparative toner 1.

Comparative Example 2

The procedure for preparation of the toner 1 was repeated except for replacing 8 parts of the press cake pigment (solid content) into 6 parts of a powder pigment to prepare a comparative toner 2.

The image density, color reproducibility and fixability of each of the toners 1 to 9 and comparative toners 1 to 2 were evaluated.

(Image Density Evaluation)

Four parts of each of the toners and 96 parts of ferrite carrier having a diameter of 55 μm were mixed to prepare a two-component developer. An unfixed toner image having a size of 3 cm×5 cm and a weight of 0.4 mg/CM$^2$ was formed by a copier imagio Neo C600 from Ricoh Company, Ltd. with the developer at a position 3 cm distant from the end of an A4 paper T6000 70W T from Ricoh Company, Ltd., and the unfixed toner image was fixed thereon with a fixer of the copier at a constant temperature of 160° C. and a linear speed of 280 mm/sec.

The image density of the image was measured by X-Rite from X-Rite Corp.

Not less than 1.4: Good (G)

Not less than 1.3 and less than 1.4: Normal (N)

Less than 1.3: Poor (P)

The results are shown in Table 1.

(Color Reproducibility Evaluation)

An unfixed toner image having a weight of 0.4 mg/cm$^2$ was formed on Tokubishi Art N110 kg paper from Mitsubishi Paper Mills Limited, and the unfixed toner image was fixed thereon with a fixer of the copier at a constant temperature of 160° C. and a linear speed of 280 mm/sec.

Chromaticness indices a* and b* of the toner image in L*a*b* color coordinate system (CIE:1976) were measured using X-Rite 938 from X-Rite Corp. The colorfulness was determined by the following formula (I):

$$C^*=[(a^*)2+(b^*)2]^{1/2} \quad (1)$$

The colorfulness was evaluated as follows.

Not less than 70: Very good (VG)

Not less than 65 and less than 70: Good (G)

Less than 65: Poor (P)

The results are shown in Table 1.

(Fixability Evaluation)

An unfixed toner image having a size of 3 cm×5 cm and a weight of 0.85 mg/CM$^2$ was formed by a copier imagio Neo C600 from Ricoh Company, Ltd. with the developer at a position 3 cm distant from the end of an A4 paper T6000 70W T from Ricoh Company, Ltd. A fixer of the imagio Neo C600 was modified so as to be externally driven and externally temperature-controlled and whether offset occurred was visually observed at 5° C./min and a linear speed of 260 mm/sec from 120 to 200° C. The results are shown in Table 1.

The cold offset was evaluated as follows.

Not occurred up to 130° C.: Good (G)

Not occurred up to 140° C.: Normal (N)

Occurred at 140° C.: Poor (P)

The hot offset was evaluated as follows.

Not occurred up to 190° C.: Good (G)

Not occurred up to 180° C.: Normal (N)

Occurred at 180° C.: Poor (P)

TABLE 1

| | ID | | CR | | Fix. | | | | |
|---|---|---|---|---|---|---|---|---|---|
| | Va | E | CFN | E | COT | E | HOT | E | OE |
| Ex. 1 | 1.42 | G | 74 | VG | 125 | G | 195 | G | VG |
| Ex. 2 | 1.47 | G | 76 | VG | 120 | G | 185 | N | G |
| Ex. 3 | 1.32 | N | 66 | G | 135 | N | 200 | G | G |
| Ex. 4 | 1.41 | G | 73 | VG | 125 | G | 185 | N | G |
| Ex. 5 | 1.32 | N | 69 | G | 130 | N | 200 | G | G |
| Ex. 6 | 1.45 | G | 75 | VG | 125 | G | 185 | N | G |
| Ex. 7 | 1.41 | G | 68 | G | 125 | G | 195 | G | G |
| Ex. 8 | 1.31 | N | 66 | G | 125 | G | 190 | N | G |
| Ex. 9 | 1.5 | G | 71 | VG | 130 | N | 190 | N | G |
| Ex. 10 | 1.34 | N | 68 | G | 125 | G | 190 | N | G |
| Ex. 11 | 1.48 | G | 71 | VG | 125 | G | 190 | N | G |
| Ex. 12 | 1.43 | G | 74 | VG | 125 | G | 190 | G | VG |
| Ex. 13 | 1.41 | G | 70 | VG | 125 | G | 195 | G | VG |

TABLE 1-continued

| | ID | | CR | | Fix. | | | | |
|---|---|---|---|---|---|---|---|---|---|
| | Va | E | CFN | E | COT | E | HOT | E | OE |
| Com. Ex. 1 | 1.27 | P | 63 | P | 140 | P | 200 | G | P |
| Com. Ex. 2 | 1.22 | P | 61 | P | 125 | G | 195 | G | P |

ID: Image Density
Va: Value
CR: Color Reproducibility
CFN: Colorfulness
E: Evaluation
Fix.: Fixability
COT: Cold Offset Temperature
HOT: Hot Offset Temperature
OE: Overall Evaluation The crosslinking reaction initiator in Comparative Example 1 was not diluted and the crosslinking reaction was excessive. Therefore, the toner had low meltability and remained an interface, producing images having low image density and color reproducibility and having poor low-temperature fixability.

The toners in Examples 1 to 13 satisfying the requirements of the present invention produced images having high image density and color reproducibility, and good fixability.

Namely, a toner including a binder resin prepared by diluting a crosslinking reaction initiator with a release agent and a press cake pigment produces images having high image density and color reproducibility, and good fixability. Further, the toner having a number-average molecular weight of from 4,000 to 12,000, and a ratio of a weight-average molecular weight to a number-average molecular weight of from 2 to 8 produces images having high image density and color reproducibility, and good fixability. Further, when the release agent is a direct-chain hydrocarbon, the toner produces images having high image density and color reproducibility, and good fixability. Further, the toner including a release agent in an amount of from 1 to 6% by weight has better fixability.

Further, the toner including a colorant in an amount of from 3 to 10% by weight produces images having high image density and color reproducibility.

This application claims priority and contains subject matter related to Japanese Patent Application No. 2009-052251, filed on Mar. 5, 2009, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method for preparing a toner, the method comprising:
combining a crosslinking reaction initiator and a release agent to dilute the crosslinking reaction initiator to a concentration;
adding the diluted crosslinking reaction initiator to a polyester resin having an unsaturated bond to obtain a mixture;
melting and kneading the mixture to obtain a binder resin;
mixing the binder resin and at least one colorant to obtain a toner mixture;
melting and kneading the toner mixture to obtain a toner melt;
cooling and solidifying the toner melt to obtain a solidified toner; and
pulverizing the solidified toner to obtain pulverized toner particles.

2. The method for preparing a toner of claim 1, wherein a number-average molecular weight (Mn) of the binder resin is from 4,000 to 12,000 and a ratio of a weight-average molecular-weight to the number-average molecular weight (Mn) of the binder resin is from 2 to 8.

3. The method for preparing a toner of claim 1, wherein the release agent is a straight-chain hydrocarbon.

4. The method for preparing a toner of claim 1, wherein the toner mixture is melted and kneaded in an open roll kneader.

5. The method for preparing a toner of claim 1, wherein the colorant is a pigment presscake which has been washed.

6. The method for preparing a toner of claim 1, further comprising:
classifying the pulverized toner particles.

7. The method for preparing a toner of claim 6, further comprising:
mixing the classified pulverized toner particles with an inorganic particulate material.

8. The method for preparing a toner of claim 1, wherein the concentration of the crosslinking reaction initiator in the diluted combination with the release agent is from 5 to 15% by weight.

9. A method for preparing a toner, the method comprising:
combining a crosslinking reaction initiator and a release agent to dilute the crosslinking reaction initiator to a concentration;
adding the diluted crosslinking reaction initiator to a mixture comprising:
a polyester resin having an unsaturated bond;
at least one colorant; and
optionally, a charge control agent; to obtain a toner mixture;
melting and kneading the toner mixture to obtain a toner melt;
cooling and solidifying the toner melt to obtain a solidified toner; and
pulverizing the solidified toner to obtain pulverized toner particles.

10. The method for preparing a toner of claim 9, wherein a number-average molecular weight (Mn) of the binder resin is from 4,000 to 12,000 and a ratio of a weight-average molecular-weight to the number-average molecular weight (Mn) of the binder resin is from 2 to 8.

11. The method for preparing a toner of claim 9, wherein the release agent is a straight-chain hydrocarbon.

12. The method for preparing a toner of claim 9, wherein the toner mixture is melted and kneaded in an open roll kneader.

13. The method for preparing a toner of claim 9, wherein the colorant is a pigment presscake which has been washed.

14. The method for preparing a toner of claim 9, further comprising:
classifying the pulverized toner particles.

15. The method for preparing a toner of claim 9, further comprising:
mixing the pulverized toner particles with an inorganic particulate material.

16. The method for preparing a toner of claim 9, wherein the concentration of the crosslinking reaction initiator in the diluted combination with the release agent is from 5 to 15% by weight.

* * * * *